US007712552B2

(12) United States Patent
In

(10) Patent No.: US 7,712,552 B2
(45) Date of Patent: May 11, 2010

(54) WATER HAMMER

(76) Inventor: Suk Shin In, Jungheung S-Class Apt 101-1405, 976 Yongbong-dong, Buk-gu, Gwangju 500-670 (KR)

( * ) Notice: Subject to any disclaimer, the term of this patent is extended or adjusted under 35 U.S.C. 154(b) by 412 days.

(21) Appl. No.: 10/593,992

(22) PCT Filed: Mar. 24, 2005

(86) PCT No.: PCT/KR2005/000862

§ 371 (c)(1),
(2), (4) Date: Jun. 20, 2007

(87) PCT Pub. No.: WO2005/090737

PCT Pub. Date: Sep. 29, 2005

(65) Prior Publication Data

US 2007/0261869 A1 Nov. 15, 2007

(30) Foreign Application Priority Data

Mar. 24, 2004 (KR) ..... 10-2004-0020138
Jul. 23, 2004 (KR) ..... 10-2004-0057657

(51) Int. Cl.
*E21B 4/14* (2006.01)

(52) U.S. Cl. ..... 175/296; 175/297

(58) Field of Classification Search ..... 175/296, 175/297, 414
See application file for complete search history.

(56) References Cited

U.S. PATENT DOCUMENTS 3,273,657 A * 9/1966 Willems et al. ..... 173/121
4,660,658 A 4/1987 Gustafsson
5,107,944 A 4/1992 Gustafsson
5,396,965 A * 3/1995 Hall et al. ..... 173/73
5,787,995 A 8/1998 Ekwall et al.

FOREIGN PATENT DOCUMENTS

JP 10-088952 4/1998
WO WO 94/23171 10/1994

* cited by examiner

*Primary Examiner*—William P Neuder
(74) *Attorney, Agent, or Firm*—Mitchell P. Brook; Luce, Forward, Hamilton & Scripps

(57) ABSTRACT

A water hammer using a drive rod is provided. The water hammer includes a tubular main body having a hollow portion; a socket coupled to an upper end of the main body and having a water pressure supply passage; a cylindrical piston housing connected to the main body; a piston slidably installed in the piston housing, for striking a bit of a bit unit installed at a lower portion of the main body, having a hollow portion through which water is discharged, an annular pressurizing portion protruding on its outer circumferential surface, and a first communication hole connected to the hollow portion; a sliding member fitted into the main body to be coupled to the piston housing, defining a valve installation space, and creating a space portion in which the piston is received when the piston is elevated; a valve member defining the valve installation space into first and third space portions along the length of the piston, the first and second space portions having different cross-sectional areas from each other, and valve member forming a second space portion between the first and third space portions, connected to the hollow portion of the piston and connected to the first space portion when the piston is elevated; and a water pressure supply unit for supplying high pressure water delivered to the water pressure supply passage of the socket to the first and second space portions.

15 Claims, 9 Drawing Sheets

[Fig. 1]
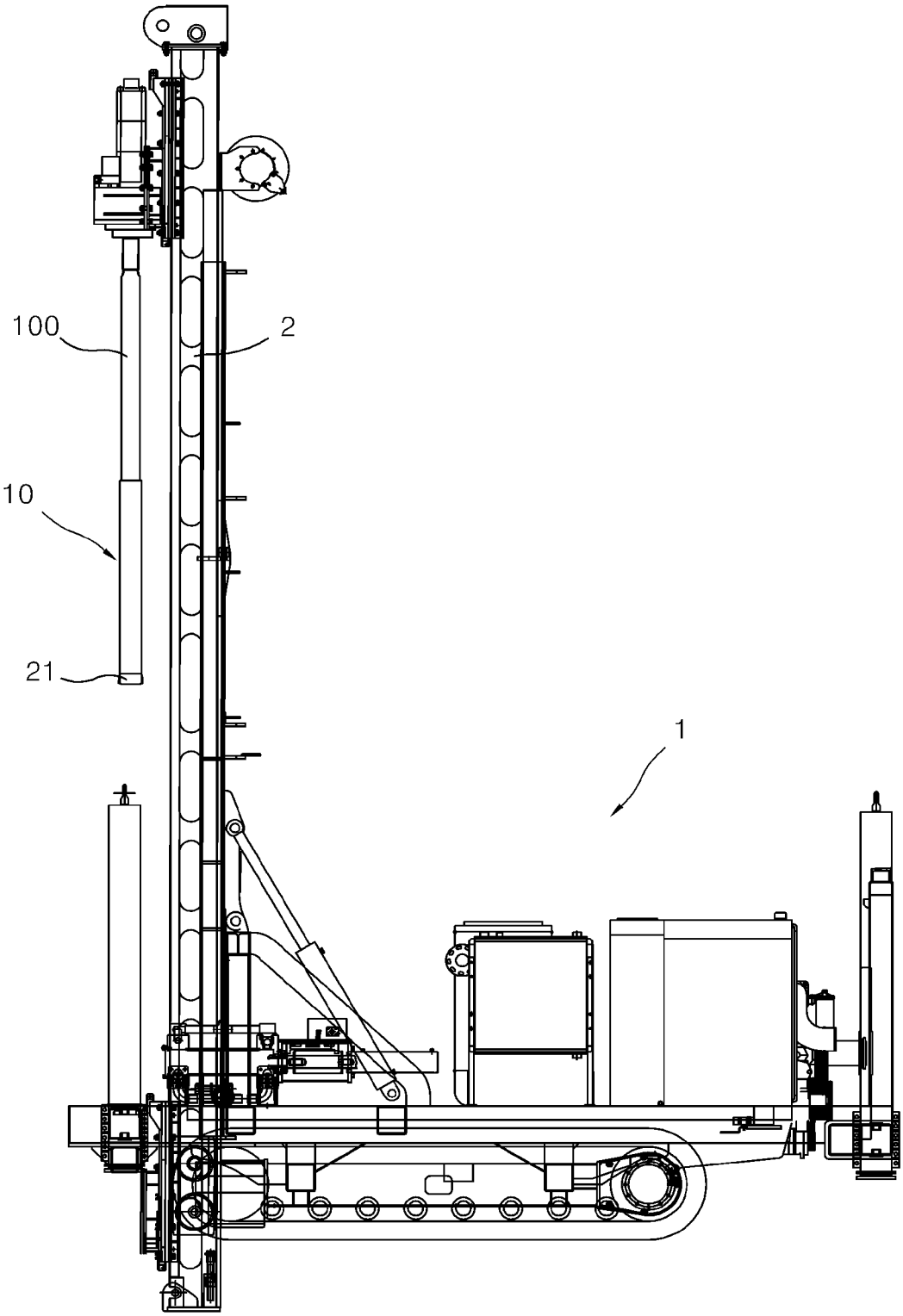

[Fig. 2]
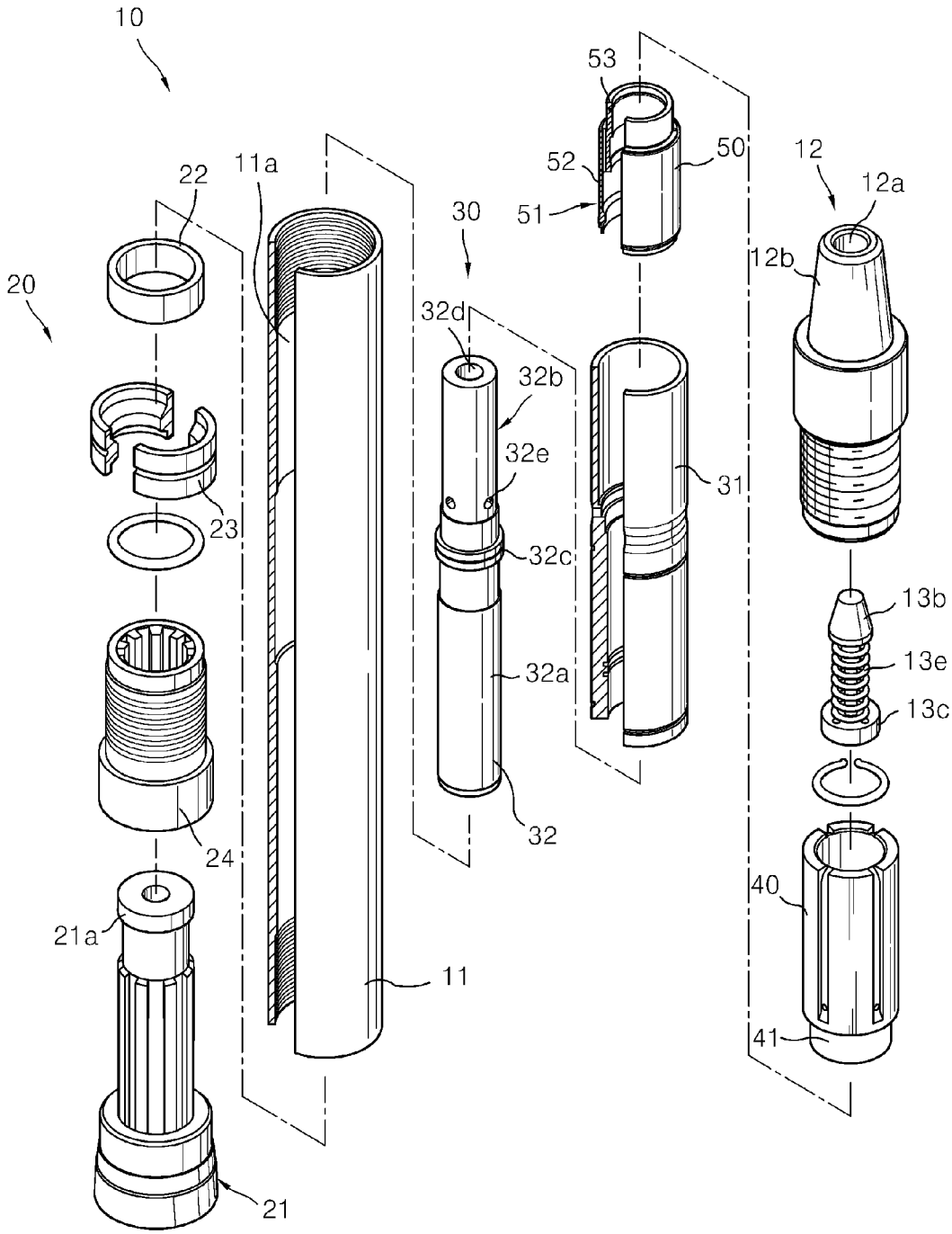

[Fig. 3]
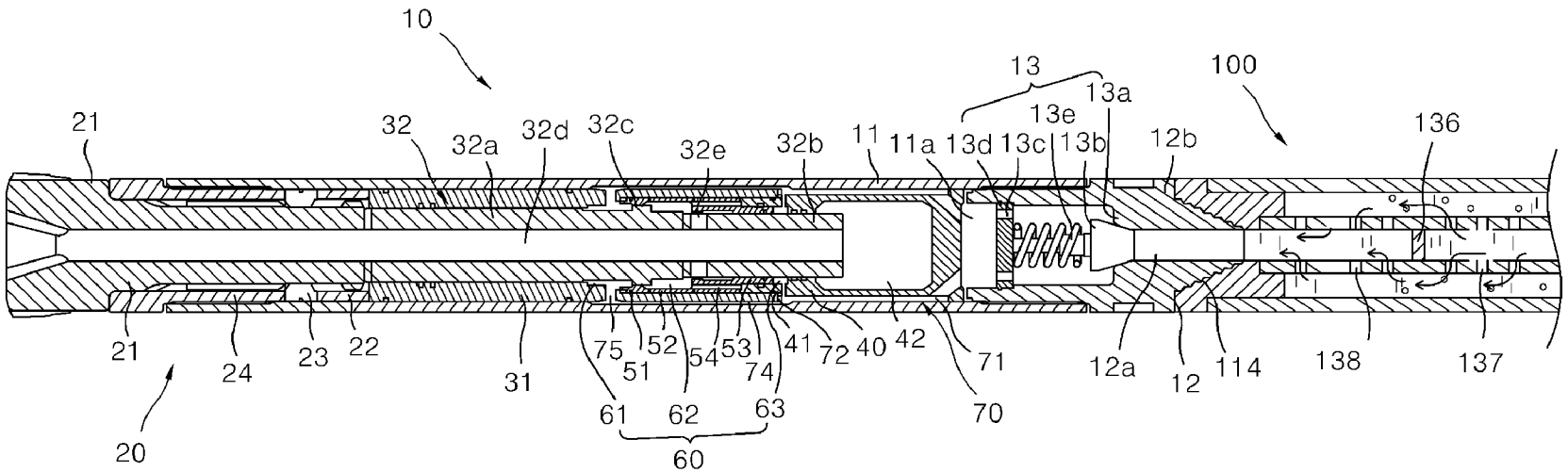

[Fig. 4]
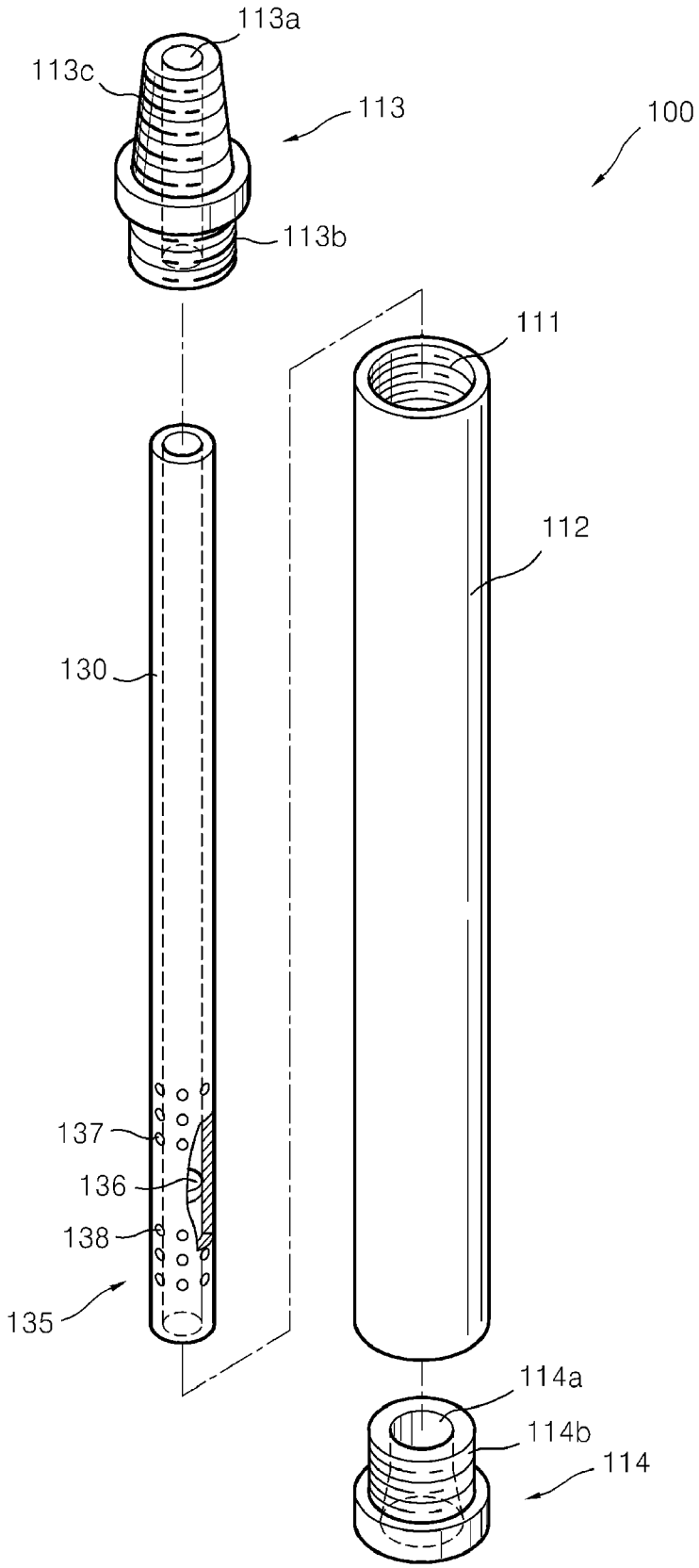

[Fig. 5]
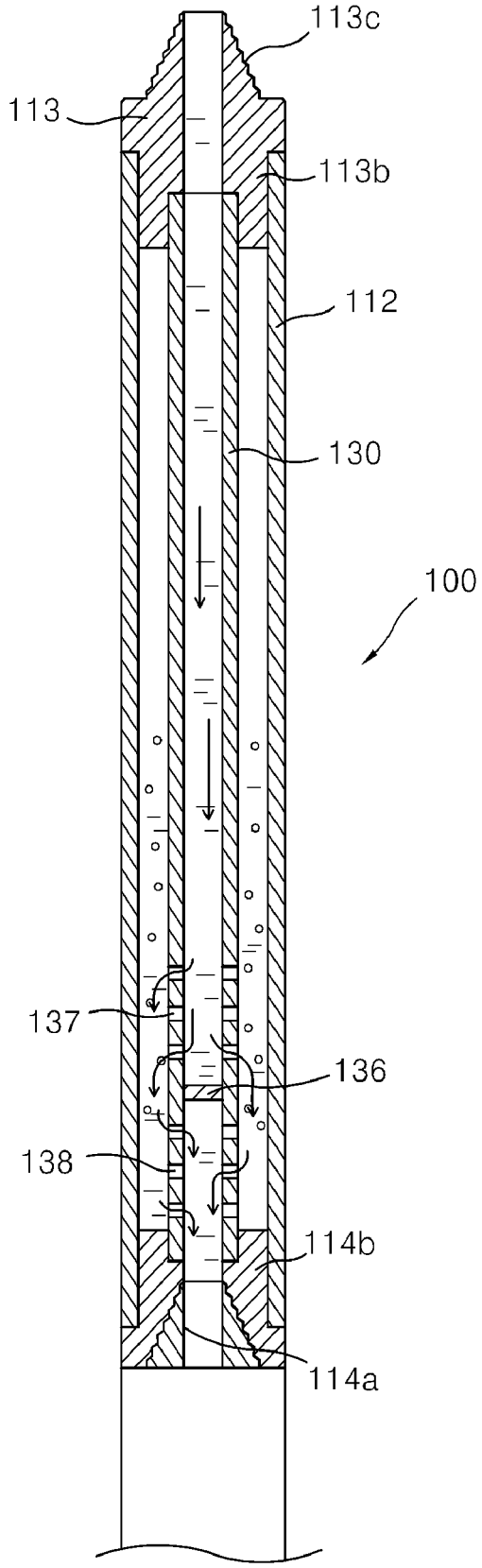

[Fig. 6]
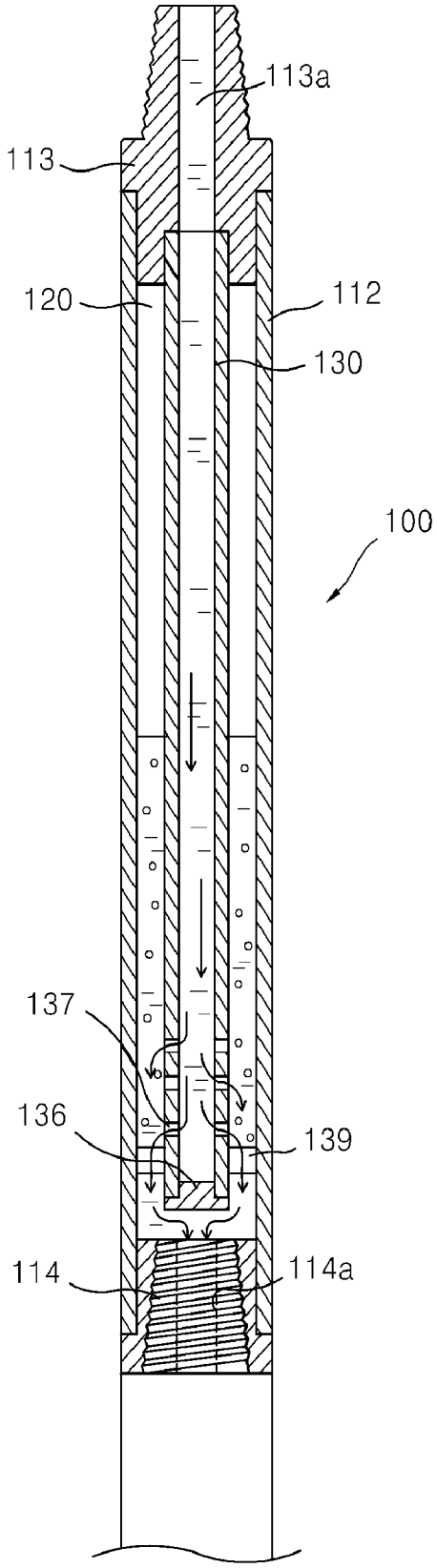

[Fig. 7]
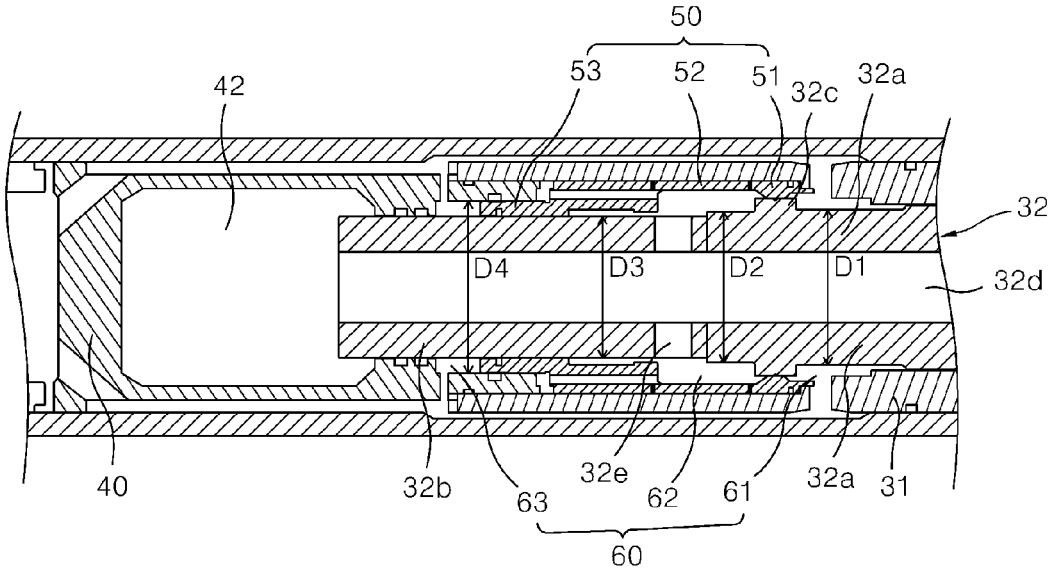
[Fig. 8]
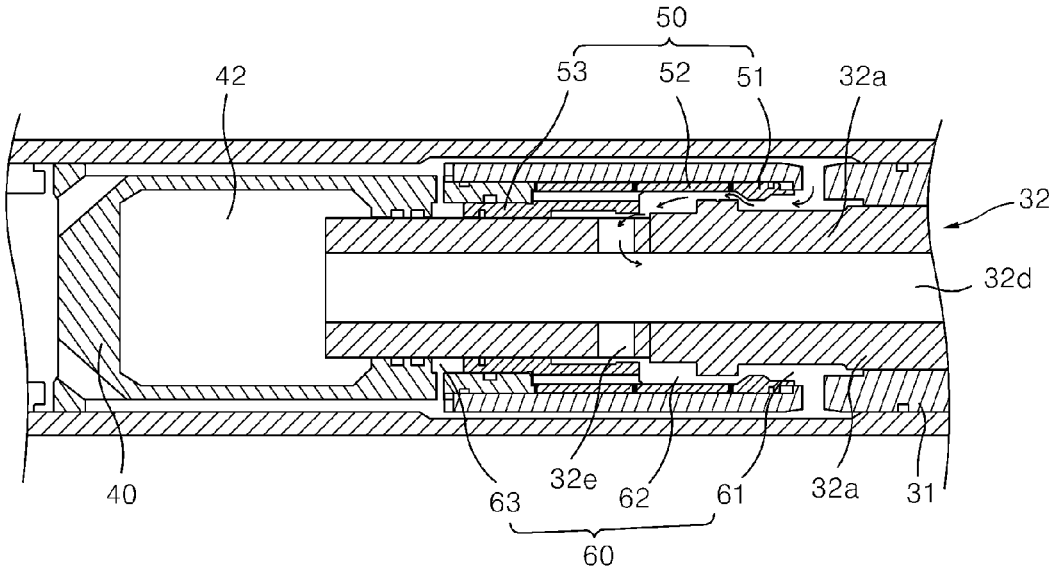

[Fig. 9]
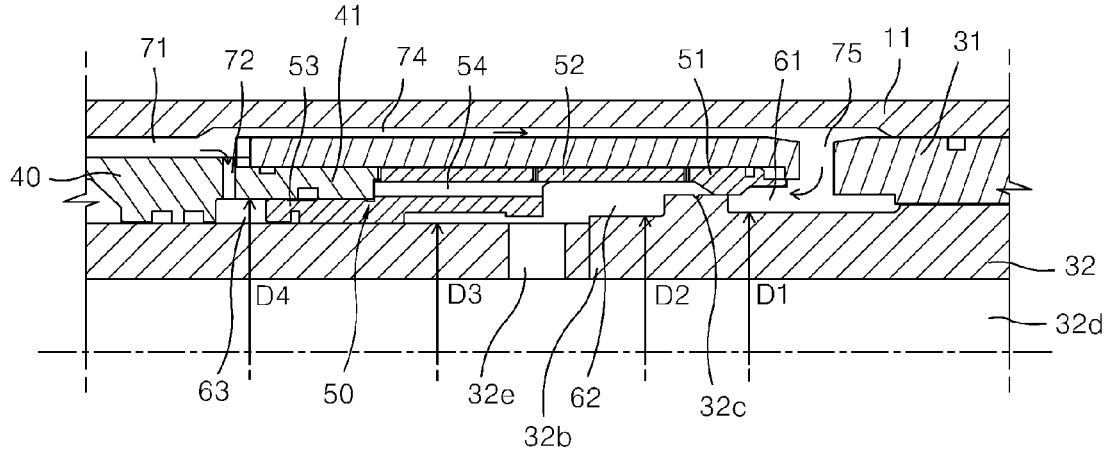
[Fig. 10]
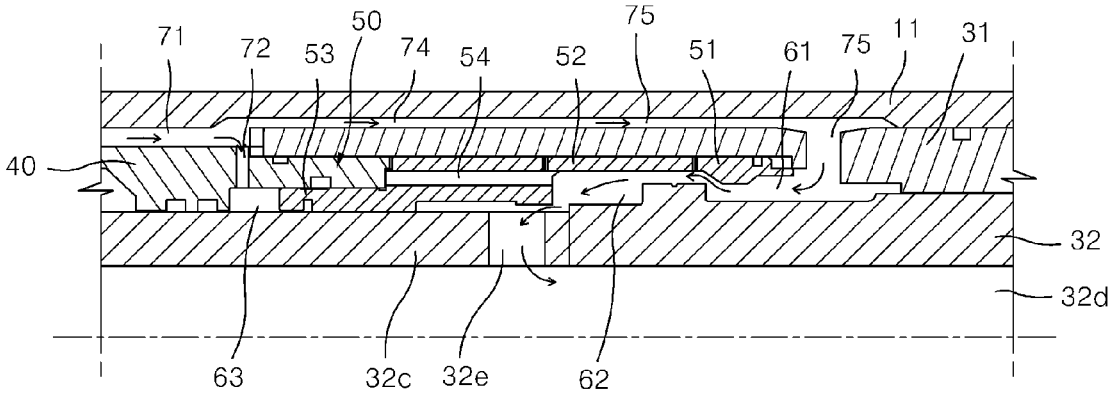
[Fig. 11]
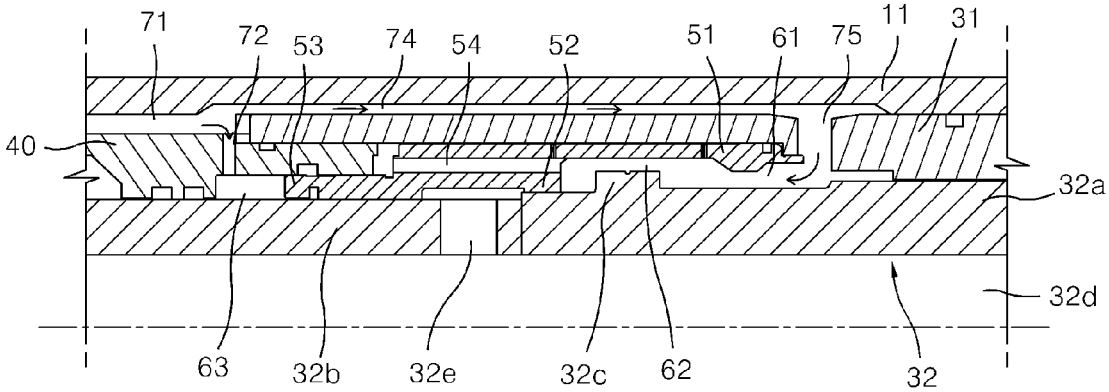

[Fig. 12]
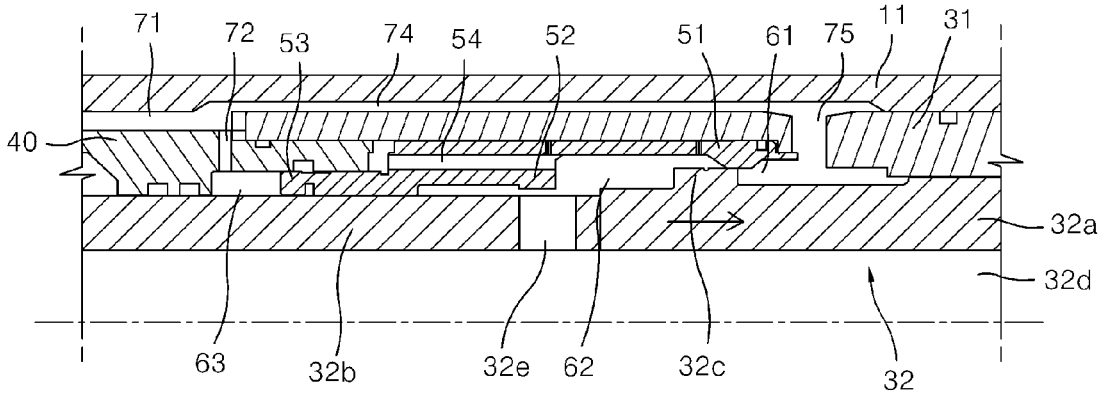

WATER HAMMER

TECHNICAL FIELD

The present invention relates to a boring machine, and more particularly, to a drive rod of machine which is directly driven using high pressure water and enables a relatively deep hole to be bored in the ground, like a drilling work, and a water hammer using the same.

BACKGROUND ART

A boring machine for perforating the ground is generally based on a technique of simply circulating a bit (Oscillating method), a technique of not only circulating a bit or a ball cutter but also pressurizing the same (Reverse Circulation Drilling method: ROC), and so on. According to the oscillating method, in a state in which a standard casing having a diameter of 800 to 3000 mm is clamped by a hydraulic chuck, boring is performed by oscillating a cylinder installed rotatably in a left-right direction. According to the ROC method, the ground is bored using a drive rod having a rotary bit or ball cutter installed at its end portion by rotating the bit or ball cutter. The oscillation method can cope with a soft ground condition, that is, a boring work is properly carried out through soft ground such as soil. However, for a hard-boring operation, it is necessary to demolish rocks under the ground by dropping a large-sized hammer, requiring additional equipment such as a pile driver.

Meanwhile, in the RCD method, which is an advanced method compared to the oscillation method from the viewpoint of boring capacity, a soil layer is first dug using an oscillator or a rotator, both a soft rock layer and a hard rock layer are dug by rotating drill rod a specially designed bit attached to its end portion, and air-suctioning circulating water and cloven rocks through a drill rod pipe, followed by hoisting the rocks to the surface of the ground. The RCD method is essentially employed in large-diameter cast-in-place and top-down method for a foundation work.

Korean Patent Publication No. 10-0372049 discloses a boring machine using a crane. The disclosed boring machine includes a drive rod, a tool housing, a breaker, a bit, a case, and an air pressure excavating means. The drive rod transfers water pressure and air generated from a hydraulic drive unit to a digging position along water pressure and air passages. The tool housing is mounted to an end portion of the drive rod and accommodates various structures. The breaker, which is provided at an upper end of the inside of the tool housing, has a piston to strike by water pressure while elevating. The bit, which is vertically movably attached to a lower end of the tool housing, performs a boring operation such that the breaker strikes the piston. The case is inserted into the tool housing to form a passage ranging from the ground surface to the digging position. The air pressure excavating means is connected to the passages and air holes to allow the tool housing to communicate with the bit such that the air pressure supplied from the outside of the tool housing is discharged through a lower portion of the bit.

In the above-described boring machine, the piston of the breaker is driven by a hydraulic drive unit. Thus, as the depth of a bored hole increases, the configuration becomes complicated, and additional equipments for driving the same become bulky. Particularly, since the bit digs soil using air pressure, it is quite difficult to smoothly excavate the soil as the hole becomes deeper. In addition, when air is used as a pneumatic actuator of a piston breaker, a large amount of air is consumed, resulting in a considerable increase in the operation cost.

In the above-described boring machine, the hammer is installed in each drive rod and a water pressure line and a high pressure line are separately formed to operate the piston of the hammer and to rotate a digging unit. A gas chamber of a back head is provided at an upper end of the piston operated by a water pressure supplied through the drive rod. A nitrogen gas is injected into the gas chamber of the back head. When the piston is lowered by the injected nitrogen gas, an impact applied to a target is increased.

As described above, when the gas chamber of the back head is provided at an upper end of the piston, the gas pressure of the gas chamber should be relatively increased to withstand an earth pressure, which becomes increasingly greater as the depth of the bored hole increases. If the pressure of the back head gas chamber is not high enough, the striking force of the bit is undesirably reduced.

DISCLOSURE OF INVENTION

To solve the above problems, it is an objective of the present invention to provide a drive rod of a boring machine having a simplified structure by operating a water hammer for directly striking a bit using a water pressure.

It is another objective of the present invention to provide a drive rod of a boring machine, which can reduce consumption of a large amount of water used to drive the same by operating a piston using a difference in the pressure applied to an internal surface selectively defined by a valve and can be applied to existing boring equipment without special improvement, and a water hammer connected thereto.

It is still another objective of the present invention to provide a drive rod of a boring machine, which enables a relatively deep hole to be bored in the ground, and a water hammer connected thereto.

It is yet another objective of the present invention to provide a drive rod of a boring machine, which can increase a striking force of a bit by adding a compressive force to a pneumatic force of a piston for lowering the piston using a water pressure.

It is a further objective of the present invention to provide a drive rod of a boring machine, which can prevent a piston from malfunctioning due to intermingling of water and air by isolating the air from the water as a pneumatic actuator of a hammer, and can increase a striking force of the hammer using a simplified structure.

According to an aspect of the present invention, there is provided a water hammer of a boring machine comprising: a tubular main body having a hollow portion; a socket coupled to an upper end of the main body and having a water pressure supply passage; a cylindrical piston housing connected to the main body; a piston slidably installed in the piston housing, for striking a bit of a bit unit installed at a lower portion of the main body, having a hollow portion through which water is discharged, an annular pressurizing portion protruding on its outer circumferential surface, and a first communication hole connected to the hollow portion; a sliding member fitted into the main body to be coupled to the piston housing, defining a valve installation space, and creating a space portion in which the piston is received when the piston is elevated; a valve member defining the valve installation space into first and second space portions along the length of the piston, the first and second space portions having different cross-sectional areas from each other, and valve member forming a second space portion between the first and third space portions connected to the hollow portion of the piston and connected to the first space portion when the piston is elevated; and a water pressure supply unit for supplying high pressure water delivered to the water pressure supply passage of the socket to the first and second space portions.

According to another aspect of the present invention, there is provided a water hammer comprising: a tubular main body having a hollow portion; a socket coupled to an upper end of the main body and having a water pressure supply passage; a cylindrical piston housing connected to the main body; a piston slidably installed in the piston housing, having a hollow portion through which water is discharged, an annular pressurizing portion protruding on its outer circumferential surface, and a first communication hole connected to the hollow portion; a sliding member fitted into the main body to be coupled to the piston housing, defining a valve installation space, and creating a space portion in which the piston is received when the piston is elevated; a valve member slidably installed in the valve installation space and defining the same into a first space portion and a second space portion, the cross-sectional area of the first space portion along the length of the piston being larger than that of the second space portion along the length of the first space portion, and the valve member defining a third space portion between the first and second space portions, connected to the hollow portion of the piston; and a water pressure supply unit for supplying pressure water to the first and second space portions to firstly elevate the valve member using a difference between the cross-sectional area of the first space portion and the cross-sectional area of the second space portion to secondly elevate the piston, causing the water used to elevate the housing to be discharged to the hollow portion of the piston in such a manner that the first and second space portions are connected to each other when the piston elevates, and supplying water pressure to the third space portion to cause the valve member to be lowered.

In the present invention, the valve member includes a first shield portion installed between the outer circumferential surface of the pressurizing portion and the internal surface of the cylinder member, an extending portion extending from the first shield portion and forming a passage through which the first and second space portions are connected to each other when the first shield portion and the pressurizing portion are separated from each other, and a second shield portion extending from the extending portion to be slidably coupled to an end portion of the sliding member to form the third space portion. In addition, the water pressure supply unit includes a pump for supplying water having a predetermined pressure to the water pressure supply passage of the socket, a first water pressure passage is formed on at least one of the outer circumferential surface of the sliding member and the main body, a second communication hole connected to the third space portion is formed in the sliding member, a second water pressure passage is formed on at least one of the outer surface of the sliding member and the inner circumferential surface of the main body so as to be connected to the second water pressure passage, and a third communication hole is formed to connect the second water pressure passage with the first space portion.

The drive rod according to the present invention comprises: a tubular main body having a hollow portion; a first connection member installed at an upper portion of the main body and having an inlet; a second connection member installed at a lower portion of the main body and having an outlet; and an internal pipe having an upper end fixed to be connected with the inlet of the first connection member, extending toward the second connection member to partition the hollow portion of the main body lengthwise to form an air storage portion, and having at least one discharge hole for discharging water in a radial direction to isolate water from air, the discharge hole formed at an end portion of the internal pipe.

The end portion of the internal pipe is connected to the outlet of the second connection member, a shield plate is installed at a side of the internal pipe proximal to the second connection member to cause water induced through the internal pipe to be discharged through the discharge hole, and at least one entrance hole for causing water discharged through the discharge hole to be induced to the outlet is installed at the internal pipe disposed at the lower portion of the shield plate.

BRIEF DESCRIPTION OF THE DRAWINGS

FIG. 1 is a schematic side view of a boring machine according to the present invention;

FIG. 2 is a partial perspective view of a water hammer according to the present invention;

FIG. 3 is a cross-sectional view illustrating a state in which a drive rod and a water hammer are mounted;

FIG. 4 is a partial perspective view of a drive rod according to an embodiment of the present invention;

FIG. 5 is a cross-sectional view of the drive rod;

FIG. 6 is a partial perspective view of a drive rod according to another embodiment of the present invention; and FIGS. 7 through 12 are cross-sectional views illustrating an operation state of the water hammer according to the present invention.

BEST MODE FOR CARRYING OUT THE INVENTION

As shown in FIG. 1, a water hammer 10 according to the present invention is configured to strike a bit 21 guided by the lead 2 and installed at an end portion of a drive rod 100 allowed to be lowered and rotate by means of a driving means in a state in which a lead 2 stands upright perpendicularly with respect to a machine body 1.

FIGS. 2 and 3 illustrate the water hammer 10 according to an embodiment of the present invention.

Referring to the drawings, the water hammer 10 includes a tubular main body 11 having a hollow portion 11*a*, a socket 12 coupled to an end of the main body 11, having a water pressure supply passage 12*a*, and connected to the drive rod 100 for supplying high pressure water, a bit unit 20 installed at a lower portion of the main body 11 and having a bit 21 slidably moving lengthwise by a predetermined length to bore holes through rock and soil layers, and a water hammer unit 30 installed in the main body 11 between the socket 12 and the bit unit 20.

The aforementioned water hammer 10 will now be described in more detail by constituent.

The main body 11 is tubular shaped, and preferably has the same diameter with that of the drive rod 100. The socket 12 is engaged with the main body 11 by screw- or pin-engagement, and has a tapered engagement portion 12*b* provided at its upper portion to be engaged with the drive rod 100, and a water pressure supply passage 12*a* formed lengthwise. The socket 12 further includes a check valve unit 13 for preventing backflow of water through the water pressure supply passage 12*a*.

The check valve unit 13 includes a sheet portion 13*a* integrally formed with the socket 12 such that an outlet of the water pressure supply passage 12*a* is spreadly opened, a check valve member 13*b* contacting with and connected with the sheet portion 13*a*, and an elastic member 13*e* coupled to the socket 12, supported to a support member 13*d* having a plurality of throughholes 13*c*, and elastically biasing the check valve member 13*b* toward the sheet portion 13*a*. The check valve unit 13 is not limited to that described in the illustrative embodiment and any structure capable of preventing backflow of water supplied through the water pressure supply passage 12*a* can be used as the check valve unit 13.

Meanwhile, the drive rod 100 connected to the socket 12 includes a plurality of interconnected drive rod 100. As shown in FIGS. 3 through 6, each of the drive rod units 110 includes an accumulator means for increasing a striking force of the piston of the water hammer 10, which will now be described in more detail.

The drive rod unit 110 includes a tubular main body 112 having a hollow portion 111 formed lengthwise, a first connection member 113 fixedly installed at an upper portion of the main body 112 and having an inlet 113*a*, a second connection member 114 installed at a lower portion of the main body 112 and having an outlet 114*a*, and an internal pipe 130 having an upper end fixed to be connected with first connection member 113 and partitioning an internal hollow portion of the main body 12 lengthwise to form an air storage portion 120 and a water supply passage.

The first connection member 113 is connected to an upper end of the tubular main body 112 to be engaged with another unit rod drive rod, and includes a first base 113*b* fixedly coupled to the main body 112, and a tapered engagement portion 113*c* extending from the first base 113*b*. The tapered engagement portion 113*c* has several screws formed on its outer surface for screw engagement.

The second connection member 114 is connected to a lower end of the tubular main body 112, and includes a second base 114*b* coupled to a lower end of the main body 112, and an outlet 114*a* formed at its center.

The first and second connection members 113 and 114 are not limited to the above examples, and they may take any forms that are installed at opposite sides of the main body 112 to be connected with adjacent drive rod units for interconnecting the drive rod units.

Meanwhile, the internal pipe 130, disposed in a hollow portion 111 of the main body 112, has a diameter relatively smaller than that of the hollow portion 111, and its upper end is connected with an inlet 113*a* of the first connection member 113 to partition the hollow portion 111, thereby defining the air storage portion 120. Here, the first connection member 113 and the internal pipe 130 are connected with each other by welding, so that the air stored in the air storage portion 120 may not be exhausted through the inlet 113*a* or a connected portion of the main body 112 and the first connection member 113, that is, a hermetical seal must be kept. At the lower end portion of the internal pipe 130 is further provided a separation unit 135 for isolating air from the water supplied through the internal pipe 130 to be stored in the air storage portion 120. As shown in FIGS. 4 and 5, the separation unit 135 includes a shield member 136 for shielding the water causing water flowing through the internal pipe 130 at the end portion of the internal pipe 130, and a discharge hole 137 formed at the upper portion of the internal pipe 130 adjacent with the shield member 136, for causing the water flowing through the internal pipe 130 to be discharged in a radial direction corresponding to the air storage portion 120, that is, to be discharged between the outer circumferential surface of the internal pipe 130 and the inner circumferential surface of the main body 112 to be stored in the air storage portion 120. In this case, the water discharged from the discharge hole 137 of the internal pipe 130 is discharged through the outlet 114*a* of the second connection member 114. The lower end portion of the internal pipe 130 is supported by a rib 139 installed between the outer circumferential surface of the internal pipe 130 and internal surface of the main body 112.

As shown in FIG. 6, the end portion of the internal pipe 130 may also be supported by the outlet 114*a* of the second connection member 114. In this case, a plurality of entrance holes 138 are formed in the internal pipe 130 under the shield member 136, allowing the water discharged from the discharge hole 137 to flow through the inlet 114*a* of the first connection member 114. In this case, the discharge holes 137 and the entrance holes 138 should be sufficiently provided so as not to be interfered by water flow.

The water hammer 10 is connected with the drive rod unit 110 having accumulator means for increasing a striking force, and is driven by elevating the piston using water having a predetermined pressure supplied through the water pressure supply passage 12*a* of the socket 12, which is illustrated in FIGS. 2 and 7-12.

Referring to the drawing, the water hammer unit 30 includes a cylindrical piston housing 31 connected to the hollow portion 11*a* of the main body 11, and a piston 32 slidably installed in the piston housing 31 to strike the bit 21. The piston 32 includes a guide portion 32*a* guided as it slidably moves in the piston housing 31, and a stepped portion 32*b* formed to be gradually stepped between the guide portion 32*a* and the internal surface of the piston housing 31 to form a valve installation space portion 60 where a valve member 50 is to be installed. A pressurizing portion 32*c* having a diameter greater than that of the guide portion 32*a* is formed in the stepped portion 32*b* proximal to the guide portion 32*a*. A hollow portion 32*d* is formed in the piston 32 lengthwise, and the stepped portion 32*b* has a first communication hole 32*e* connected to the hollow portion 32*d*. As shown in FIG. 7, the stepped portion 32*b* of the piston 32 is formed such that a diameter D1 of the guide portion 32*a* is greater than a diameter D2 of the stepped portion 32*b* in view of the pressurizing portion 32*c*, and a diameter of the first communication hole 32*e* is smaller than the diameter D2.

Meanwhile, the internal surface of the piston housing 31 corresponding to the stepped portion 32*b* of the piston 32 has a relatively large diameter to form the valve installation space portion 60. The end portion of the piston housing 31 is connected to a sliding member 40 inserted into the main body 11 between the piston housing 31 and the socket 12. Here, the inner circumferential surface of an end portion 41 of the sliding member 40 connected to the piston housing 31 has a smaller diameter D4 so that it has a relatively smaller cross-sectional area. The sliding member 40 has a receiving portion 42 for receiving the end portion of the piston 32 when the piston 32 is elevated.

The valve member 50, which is slidably movable into the piston housing 31 and the piston 32, is installed in the valve installation space portion 60 defined by the piston housing 31, the piston 32 and the sliding member 40, thereby elevating the piston 32 by a pressure of water supplied to the valve installation space portion 60. As shown in FIGS. 1 and 2, the valve member 50 includes a first shield portion 51 installed between the outer circumferential surface of the pressurizing portion 32*e* and the inner circumferential surface of the piston housing 31 so as to have a predetermined width to define a first space portion 61, an extending portion 52 extending from the first shield portion 51 to be connected to the first communication hole 32*e* to form a second space portion 62, and a second shield portion 53 extending from an end portion of the extending portion 52 to be slidably coupled to an end portion of the piston 32 to form a third space portion 63 in cooperation with the piston 32 and the end portion 41 of the sliding member 40.

The valve member 50 includes a throughhole 54 extending from the second space portion 62 to the end portion 41 of the sliding member to reduce a cross-sectional area to which a water pressure is applied. Here, a cross-sectional area along the length of the piston 32 formed by the pressurizing portion 32*c* protruding from the outer circumferential surface of the piston 32 and the first shield portion 51 is relatively wider than that formed between the outer circumferential surface of the stepped portion 32*b* and the inner circumferential surface of the end portion 41 of the sliding member 40. In addition, the first shield portion 51 contacting with the pressurizing portion 32*c* has a length in which a contact state with the pressurizing portion 32*c* is not removed even when the valve member 50 is elevated. As the contact state is removed due to elevation of the piston 32, the water supplied to the first space portion 61 to elevate the piston 32 is preferably discharged through the second space portion 62, the first communication hole 32*e* and the hollow portion 32*d* of the piston 32. Although not shown, the third space portion 63 and the receiving portion 42 of the sliding member 40 may be interconnected. Here, at an initial elevating stage of the piston 32, that is, at a time when the first stepped portion 51 and the pressurizing portion 32*c* are separated from each other, the first communication hole 32*e* and the second space portion 62 are connected to each other. As the piston 32 is further elevated, a portion of the piston 32 having a diameter D2 is connected with the extending portion 52 and a contact state between the first communication hole 32*e* and the second space portion 62 can be prevented.

In order to elevate the valve member 50 and the piston 32, a water pressure supply unit 70 for supplying water having a predetermined pressure, that is, a water pressure, is provided in the first space portion 61 and the third space portion 63. The water pressure supply unit 70 includes a pump (not shown) for supplying water pressure to the water pressure supply passage 12*a* of the socket 12, a first water pressure passage 71 formed on at least one of the outer circumferential surface of the sliding member 40 and the main body 11, and a second communication hole 72 formed in the main body 11 to connect the first water pressure passage 71 with the third space portion 63. In addition, a second water pressure passage 74 is formed on at least one of the outer surface of the sliding member and the inner circumferential surface of the main body so as to be connected to the first water pressure passage 71, and a third communication hole 75 is formed in the piston housing to connect the second water pressure passage 72 with the third space portion 63.

In the water pressure supply unit, in a case where the second space portion 63 and the receiving portion 42 of the sliding member 40 are connected with each other, it is not necessary to form the second communication hole 72.

The bit unit 20 is installed at the lower end of the main body 11 to perform a boring operation. The bit unit 20 includes a collar member 22 inserted into the main body 11, a bit 21 having a hooking part 21*a* with an end portion slidably supported by the collar member 21, a bit locker 23 inserted into the main body 11 and preventing the hooking part 21*a* of the bit 21 from being separated from the main body 11, and a front locker 24 fixed to the main body 11 and spline-connected to the bit 21. The bit 21 rotating relative to the main body 11 is fixed by the front locker 24. The hooking part 21*a* and the bit locker 23 prevent the bit 21 from deviating lengthwise. The bit unit 20 is not limited to that of the above-described embodiment and any type of a bit unit slidably supported lengthwise and fixed in a rotary direction may be employed.

The operation of the aforementioned water hammer of the boring machine will now be described with reference to FIGS. 2 and 7-12.

First, in order to perform a boring operation, the water hammer 10, specifically, the tapered engagement portion 12*b* of the socket 12, is connected to the end portion of the drive rod 100 of the boring machine. In such a state, the drive rod 100 is lowered and high pressure water is supplied to the water pressure supply passage 12*a* using a pump of the drive rod 100. The water supplied through the water pressure supply passage 12*a* retracts the check valve member 13*b* elastically supported by a spring 13*e* of the check valve unit 13 to then be supplied to the hollow portion 11*a* of the main body 11. Then, the water is supplied to the first space portion 61 and the third space portion 63 through the water pressure supply unit 70, specifically, the first water pressure passage 71, the second water pressure passage 74, the second communication hole 72, and the third communication hole 75.

Since the cross-sectional area of the first shield portion 51 is wider than that of the second shield portion 53 along the length of the piston 32, a difference in the cross-sectional area between the first and second shield portions 51 and 53 generates a difference in the pressure applied to the valve member 50, thereby elevating the valve member 50, as shown in FIG. 9. Here, the first shield portion 51 is not separated from the pressurizing portion 32*c* of the piston 32. Thus, the pressure applied to the first space portion 51 is not applied outside. Some of the pressure applied to the first space portion 51 is applied to a lateral surface of the pressurizing portion 32*c*, that is, a lengthwise side of the piston 32, thereby elevating the piston 32, as shown in FIG. 10.

If the piston 32 is elevated to a predetermined height in the above-described manner, the first shield portion 51 is separated from the outer circumferential surface of the pressurizing portion 32*c*, and the water that imparts a pressure to the first space portion 51 is discharged to the second space portion 62 via a gap between the pressurizing portion 32*c* and the first shield portion 51 and to the hollow portion 32 via the first communication hole 32*e* formed in the piston 32 (see FIG. 10)

At this time, the first and second space portions 61 and 62 are connected to each other to thus reduce a water pressure. To reduce a relative cross-sectional area difference between the valve member 50 and the second shield portion 53, the pressure applied to the valve member 50 is applied to the extending portion 52 having throughholes 54, as shown in FIG. 8. Since the cross-sectional area of the second shield portion 53 is greater than that of the valve member 50, the valve member 50 is lowered. During this process, the first communication hole 32*e* is engaged with the extending portion 52 at a portion of the end portion 32*b* having the diameter D2 to then be blocked.

In such a manner, the first and second space portions 61 and 62 are connected to each other to create a sealed space. In this state, as shown in FIGS. 11 and 12, the diameter D1 of the guide portion 32*a* of the piston 32 is greater than that of the stepped portion 32*b* in view of the pressurizing portion 32*c*. Thus, the pressure applied to the pressurizing portion 32*c* of the stepped portion 32*b* becomes relatively greater, thereby lowering the piston 32 and ultimately striking the bit 21.

When the piston 32 is lowered, the outer circumferential surface of the pressurizing portion 32*c* is brought into contact with the first shield portion 51 of the valve member 50 to partition the first space portion 61. Then, the above-described process is repeated by the pressure applied to a partitioned portion of the first space portion 61, thereby allowing the piston 32 to continuously strike the bit 21.

In the course of the piston 32 lowering, the air stored in the air storage portion 120 of the drive rod unit 110 is compressed as the water pressure for actuating the hammer unit 30 increases and the depth of a bored hole is increased. Thus, the compressed force is added to an elastic force based on the lowering of the piston 32, thereby further increasing the striking force of the piston 32.

As the depth of the bored hole is increased, it is necessary to further connect unitary drive rods 110 to the drive rod. In this case, the air stored in the drive rod 100 is induced and lowered together with the water. Then, the air induced to the internal pipe 130 of a drive rod 100 proximate to the water hammer is discharged to a space between the main body 112 and the internal pipe 130 through the discharge hole 137 to create a difference in specific weight, thereby isolating the air from the water. The isolated air is elevated to then be stored in the air storage portion 120.

The thus stored air becomes compressed to a greater extent as the depth of the bored hole is increased and the water pressure is increased. As the compressed extent of the air is increased, the compressed air further increases the pressurizing force of the piston 32 when the piston 32 is lowered to perform a boring operation.

Therefore, the striking force of the piston 32 can be further increased by accelerating the piston elevating using a water pressure.

As described above, according to the present invention, the water supplied to a drive rod of a boring machine can impart an accelerating driving force to a piston of a hammer actuated by the water, thereby increasing the striking force of a bit. In addition, unlike in the prior art, it is not necessary to provide a separate gas filling unit for supplying a water pressure hammer with a gas such as nitrogen, thereby obviating a necessity of filling pressurized gas as the depth of a bored hole is increased.

INDUSTRIAL APPLICABILITY

As described above, in the water hammer of a boring machine according to the present invention, a valve unit and a piston can be directly elevated using high pressure water pumped through a drive rod, thereby simplifying the configuration of the water hammer compared to the conventional configuration in which water pressure is controlled by a pilot pressure.

In addition, since the pressure is directly applied to the valve member and the piston, there is little probability of malfunctioning, thereby increasing the operational reliability and enabling the boring machine regardless of the depth of a bored hole. Meanwhile, the striking force of a bit can be increased by imparting an accelerating driving force to the piston of the hammer. The piston of the hammer can be actuated by the water and air supplied to the drive rod. In addition, unlike in the prior art, it is not necessary to provide a separate gas filling unit, thereby obviating a necessity of filling pressurized gas as the depth of a bored hole is increased.

The invention claimed is:

1. A water hammer of a boring machine comprising:

a tubular main body having a hollow portion;

a socket coupled to an upper end of the main body and having a water pressure supply passage;

a cylindrical piston housing connected to the main body;

a piston slidably installed in the piston housing, for striking a bit of a bit unit installed at a lower portion of the main body, having a hollow portion through which water is discharged, an annular pressurizing portion protruding on its outer circumferential surface, and a first communication hole connected to the hollow portion;

a sliding member fitted into the main body to be coupled to the piston housing, defining a valve installation space, and creating a space portion in which the piston is received when the piston is elevated;

a valve member defining the valve installation space into first and third space portions along the length of the piston, the first and third space portions having different cross-sectional areas from each other, and valve member forming a second space portion between the first and third space portions, connected to the hollow portion of the piston and connected to the first space portion when the piston is elevated; and a water pressure supply unit for supplying high pressure water delivered to the water pressure supply passage of the socket to the first and third space portions.

2. The water hammer of claim 1, wherein the valve member comprises:

a first shield portion installed between the outer circumferential surface of the pressurizing portion and the internal surface of the piston housing;

an extending portion extending from the first shield portion and forming a passage through which the first and second space portions are connected to each other when the first shield portion and the pressurizing portion are separated from each other; and a second shield portion extending from the extending portion to then be slidably connected to an end portion of the sliding member to form the third space portion.

3. The water hammer of claim 2, wherein the valve member includes at least one throughhole extending from the second space portion to an end portion of the sliding member to reduce a cross-sectional area to which a water pressure is applied.

4. The water hammer of claim 1, wherein the water pressure supply unit includes a first water pressure passage formed on at least one of the outer circumferential surface of the sliding member and the main body, a second communication hole connected to the third space portion formed in the sliding member, a second water pressure passage formed on at least one of the outer surface of the sliding member and the inner circumferential surface of the main body so as to be connected to the first water pressure passage, and a third communication hole formed to connect the second water pressure passage with the first space portion.

5. The water hammer of claim 1, wherein the socket further includes a check valve unit for preventing backflow of water through the water pressure supply passage.

6. A water hammer comprising:

a tubular main body having a hollow portion;

a socket coupled to an upper end of the main body and having a water pressure supply passage;

a cylindrical piston housing connected to the main body;

a piston slidably installed in the piston housing, having a hollow portion through which water is discharged, an annular pressurizing portion protruding on its outer circumferential surface, and a first communication hole connected to the hollow portion;

a sliding member fitted into the main body to be coupled to the piston housing, defining a valve installation space, and creating a space portion in which the piston is received when the piston is elevated;

a valve member slidably installed in the valve installation space and defining the same into a first space portion and a third space portion, the cross-sectional area of the first space portion along the length of the piston being larger than that of the third space portion along the length of the first space portion, and the valve member defining a second space portion between the first and third space portions, connected to the hollow portion of the piston; and a water pressure supply unit for supplying pressure water to the first and second space portions to firstly elevate the valve member using a difference between the cross-sectional area of the first space portion and the cross-sectional area of the second space portion to secondly elevate the piston, causing the water used to elevate the housing to be discharged to the hollow portion of the piston in such a manner that the first and second space portions are connected to each other when the piston elevates, and supplying water pressure to the third space portion to cause the valve member to be lowered.

7. The water hammer of claim 6, wherein the valve member includes a first shield portion installed between the outer circumferential surface of the pressurizing portion and the internal surface of the cylinder member, an extending portion extending from the first shield portion and forming a passage through which the first and second space portions are connected to each other when the first shield portion and the pressurizing portion are separated from each other, and a second shield portion extending from the extending portion to be slidably coupled to an end portion of the sliding member to form the third space portion.

8. The water hammer of claim 6, wherein the valve member includes at least one throughhole extending from the second space portion to an end portion of the sliding member to reduce a cross-sectional area to which a water pressure is applied.

9. The water hammer of claim 6, wherein the water pressure supply unit includes a first water pressure passage formed on at least one of the outer circumferential surface of the sliding member and the main body, a second communication hole connected to the third space portion formed in the sliding member, a second water pressure passage formed on at least one of the outer surface of the sliding member and the inner circumferential surface of the main body so as to be connected to the second water pressure passage, and a third communication hole formed to connect the second water pressure passage with the first space portion.

10. The water hammer of claim 6, wherein the pressurizing portion of the piston has different diameters at its opposite ends.

11. The water hammer of claim 9, further comprising a drive rod connected to the socket to supply high pressure water.

12. The water hammer of claim 11, wherein the drive rod comprises: a tubular main body having a hollow portion;

a first connection member installed at an upper portion of the main body and having an inlet;

a second connection member installed at a lower portion of the main body and having an outlet; and an internal pipe having an upper end fixed to be connected with the inlet of the first connection member, extending toward the second connection member to partition the hollow portion of the main body lengthwise to form an air storage portion, and having at least one discharge hole for discharging water in a radial direction to isolate water from air, the discharge hole formed at an end portion of the internal pipe.

13. The water hammer of claim 12, wherein the end portion of the internal pipe is connected to the outlet of the second connection member, a shield plate is installed at a side of the internal pipe proximal to the second connection member to cause water induced through the internal pipe to be discharged through the discharge hole, and at least one entrance hole for causing water discharged through the discharge hole to be induced to the outlet is installed at the internal pipe disposed at the lower portion of the shield plate.

14. The water hammer of claim 12, wherein the end portion of the internal pipe has a shield member for causing water to be discharged through the discharge hole, and is supported by at least one rib installed on the internal surface of the main body.

15. The water hammer of claim 12, wherein the drive rod includes a tubular main body having a hollow portion, and an accumulator unit for isolating the water induced from the hollow portion of the main body from air.

* * * * *